US005396665A

United States Patent [19]

Raz et al.

[11] Patent Number: 5,396,665

[45] Date of Patent: Mar. 14, 1995

[54] SHOCK DAMPING DEVICE FOR FLUSH VALVE MECHANISM

[75] Inventors: Benjamin Raz, Beersheva; Zeev Raz, Omer, both of Israel

[73] Assignee: Plasson Maagan Michael Industries Ltd., Menashe, Israel

[21] Appl. No.: 114,366

[22] Filed: Sep. 1, 1993

Related U.S. Application Data

[63] Continuation-in-part of Ser. No. 703,862, May 21, 1991, abandoned.

[30] Foreign Application Priority Data

Oct. 19, 1987 [IL] Israel ..... 84220

[51] Int. Cl.[6] ..... E03D 1/14

[52] U.S. Cl. ..... 4/325

[58] Field of Search ..... 4/360, 378, 379, 380, 4/387, 388, 389, 394, 415

[56] References Cited

U.S. PATENT DOCUMENTS

| | | | |
|---|---|---|---|
| 364,289 | 6/1887 | Phillips | 4/388 |
| 622,418 | 4/1899 | Croswell | 4/388 |
| 2,879,521 | 3/1959 | Brasher | 4/56 |
| 3,955,218 | 5/1976 | Ramsey | 4/56 |
| 4,101,986 | 7/1978 | Ng et al. | 4/325 |
| 4,138,749 | 2/1979 | Clark | 4/388 |
| 4,171,547 | 10/1979 | Raz | 4/326 |
| 4,305,163 | 12/1981 | Raz | 4/325 |
| 4,587,679 | 5/1986 | Chen | 4/388 |

FOREIGN PATENT DOCUMENTS

| | | |
|---|---|---|
| 2442306 | 6/1980 | France . |
| 2601401 | 7/1986 | France . |

*Primary Examiner*—Charles E. Phillips

*Attorney, Agent, or Firm*—Jacobson, Price, Holman & Stern

[57] ABSTRACT

A flush valve mechanism for controlling the flushing action of water through the water outlet of a flush cistern, comprising, in combination: (a) a water outlet valve to effect the flushing action; (b) a buoyant device, at least indirectly engaging the outlet valve, to exert a maintaining force thereon at the completion of the lifting thereof and to hold it open while the cistern is emptying and until the completion of a predetermined flushing action; and (c) a shock damping device attachable to the outlet valve and, comprising an inverted cup-shaped member and a body member, the body member being configured to freely move within the inner surface of the cup, the cup-shaped member and the body member defining therebetween a changeable volume of substantially surrounded space and having restricted openings for the passage of water into and out of the space, whereby upon attachment of the device to the valve, any vertical movement of the water outlet valve will also be affected by the device, whereby, upon the emptying of the cistern to a predetermined level below the buoyant means and the consequent completion of the exertion of the maintaining force on the water outlet valve by the buoyant means, impact shock of the reseating of the valve disk on the valve seat is reduced by the resistance of the water forced through the restricted openings.

2 Claims, 5 Drawing Sheets

Fig.4
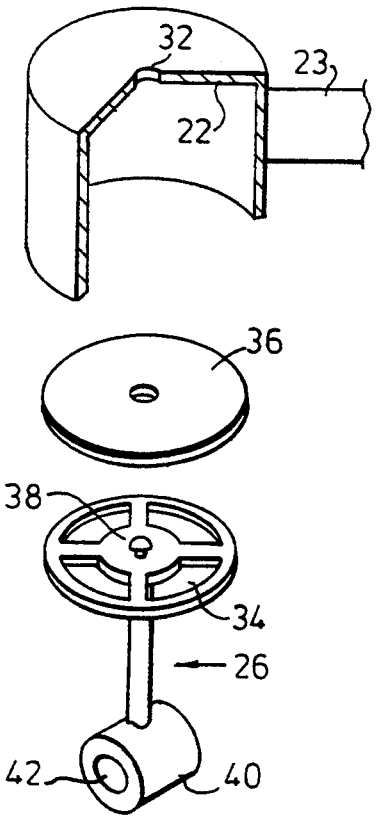
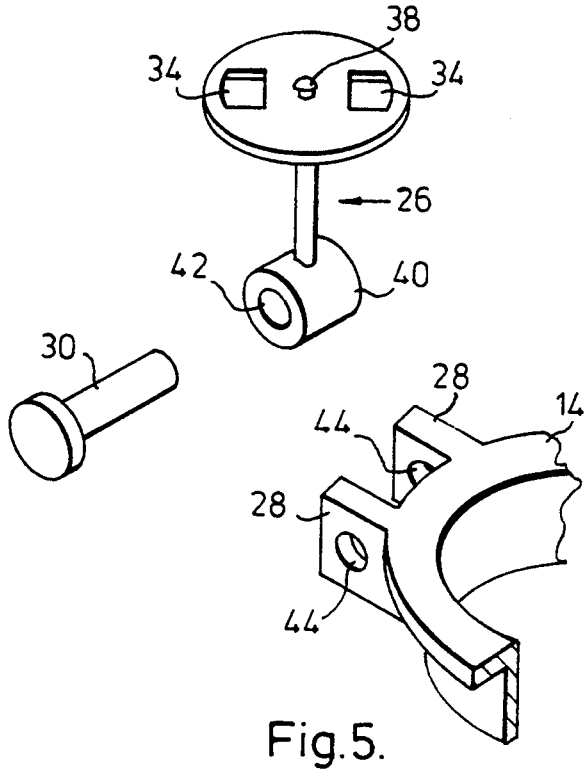
Fig.5.
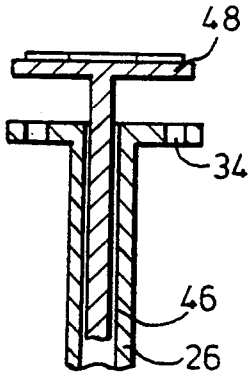
Fig.6.

SHOCK DAMPING DEVICE FOR FLUSH VALVE MECHANISM

The present specification is a continuation-in-part of pending U.S. Ser. No. 07/703,862, filed May 21, 1991, now abandoned.

The present invention relates to a flush valve mechanism for the water outlet of a flush cistern, and to improved flush cisterns provided therewith.

More particularly, the present invention relates to a quiet and long-lasting flush valve mechanism for releasing and discharging water from a flush cistern into a toilet bowl, and is adapted for use in flushing mechanisms which provide for partial as well as complete flushes, such as that described in U.S. Pat. No. 4,305,163, the teachings of which are incorporated herein by reference.

The need to preserve water resources and to avoid wastage is now accepted not only in semi-arid regions, but also in areas blessed with adequate rainfall. Much effort has gone into the development of means for saving water, and, as part of these efforts, the flush cistern toilet has been much improved to reduce wastage, as is evidenced by such U.S. Pat. Nos. as 3,955,218; 4,171,547, and many others. In particular, the development of dual-flush systems has made a very substantial contribution to saving huge quantities of fresh water.

There is, however, one requirement for a flush cistern toilet which has not yet been adequately addressed by devices of the prior art; this is the achievement of quiet operation. While some extra noise is not objectionable in noisy locations such as factories and airports, excess noise, particularly that emanating from toilets, must be avoided in homes, offices and hotels. In fact, many homemakers will be deterred from installing an improved, water-saving flush system, if the price to be paid includes excessive noise by day and by night.

Referring now in particular to the dual-volume flush systems of the type having a water outlet valve liftable off the water outlet of the flush cistern and provided with means for selectively restraining and releasing said water outlet valve to selectively allow both partial and complete flushes, the noise of highest volume as a result of impact shock is emitted as a result of the free fall of the water outlet valve at the completion of a partial flushing action. This outlet valve, which has affixed at its lower extremity a flexible seal disc, falls until impacting the valve seat of the water outlet, the resultant shock causing vibration and noise. A further undesirable by-product of this impact is accelerated wear of various parts of the flushing mechanism, and in particular of the flexible seal disc.

Two factors have been identified which explain why the above problem is more severe during a partial volume flush:

a) During a partial volume flush, the lower part of the cistern continues to hold water during the downward movement of the outlet valve assembly. The resultant water pressure on the upper surface of the sealing disc applies a downward force thereon, this force not being completely balanced at the underside of said disc, which is in a low-pressure area as a result of water flow through the cistern outlet.

b) The dynamic effect of the fluid flow near the cistern outlet applies an additional force on the lower extremity of the outlet valve and, in particular, on the seal disc. While at the completion of a full volume flush, air can enter a vertical tube water outlet valve and separate the seal disc from the fast-flowing water, this is not so during a partial-volume flush, and the seal disc is subjected to the forces resulting from entrainment of the seal disc on the fast-flowing water.

In accordance with the present invention, there is now provided the simple and inexpensive addition of a shock reduction mechanism, particularly useful for dual-volume flush cisterns of the type exemplified by U.S. Pat. No. 4,305,163. However, it is noted that the present invention can also be applied to similar types of flushing mechanisms which suffer from the same problem as described hereinabove and including mechanisms of the type offering only full-volume flushes, but in which water remains in the cistern at the completion of a full volume flush. The proposed simple mechanism reduces impact shock to a negligible level, thereby eliminating the loudest sound of the flushing action and additionally extending the useful life of the mechanism components.

Accordingly, the present invention provides a flush valve mechanism for controlling the flushing action of water through the water outlet of a flush cistern, comprising, in combination: (a) a water outlet valve liftable off said water outlet to effect said flushing action, said water outlet valve having a valve disk for sealing a valve seat of the water outlet and an upwardly extending valve stem, and further having an effectively negative overall buoyancy when the cistern is at least partially full; (b) buoyant means, at least indirectly engaging said water valve, to exert a maintaining force on said water outlet valve at the completion of the lifting thereof and to hold it open while the cistern is emptying and until the completion of a predetermined flushing action; and (c) a shock damping device, comprising an inverted cup-shaped member and a body member, said body member being configured to freely move within the inner surface of said cup, said cup-shaped member and said body member defining therebetween a changeable volume of substantially surrounded space and having or defining restricted openings for the passage of water into and out of said space, one of said members being provided with means for attachment to said water outlet valve, whereby, upon attachment of said member to said valve, any vertical movement of the water outlet valve will also be affected by said member, and the remaining member being provided with means for attachment to a stationary component of said cistern, and being located so that said body member may reciprocate inside said cup-shaped member, whereby, upon the emptying of the cistern to a predetermined level below said buoyant means and the consequent completion of the exertion of said maintaining force on said water outlet valve by said buoyant means, impact shock of the reseating of said valve disk on said valve seat is reduced by the resistance of the water forced through said restricted openings as a result of the final descent of said valve attached member towards said cistern attached member.

The invention also provides a shock-damping device in combination with a selective volume flush valve mechanism of the type adapted to selectively allow both partial and complete flushes and having a water outlet valve liftable off the water outlet of a flush cistern and having a valve disk for sealing a valve seat of the water outlet and an upwardly extending valve stem, and a first buoyant, valve-engaging assembly adapted to move independently of said water outlet valve by virtue of its buoyancy, said assembly comprising a pivotably mounted buoyant lever having at least one arm with a first buoyant means attached at one end thereof adjacent the bottom of said cistern and provided with means at its other end for selectively engaging said valve, said assembly further comprising restraining means being displaceable between a first position and a second position, said restraining means in said first position normally engaging and restraining said buoyant lever with said buoyant means in close proximity to said cistern bottom and said engaging means in disengaged relationship to said valve, said restraining means in said second position freeing said buoyant lever and allowing the same to engage and to exert a maintaining force on said water outlet valve at the completion of the lifting thereof and to hold it open until the completion of the flushing action, said water outlet valve being further provided with second buoyant means directly engaging the same for controlling the effective overall buoyancy thereof and maintaining said valve open while the cistern is emptying and until the completion of a predetermined partial flushing action, whereby said lift valve, in combination with said second buoyant means, will have an effectively positive overall buoyancy when the water in the cistern is at a predetermined full level and an effectively negative overall buoyancy when the water in the cistern is emptied to a second, lower, partially full level; said selective volume flush valve mechanism further having dual acutuating means, the first of said means comprising a mechanism for effecting the disengagement of said valve from said water outlet while said restraining means is maintained in said first position for enabling partial flushes based on the maintaining action of said second buoyant means and the second of said actuating means comprising a mechanism for effecting the disengagement of said valve from said water outlet and for displacing said restraining means from its first position to said second position, to enable said buoyant lever to exert a maintaining force on said disengaged water valve to overcome its negative buoyancy and to hold it open while the cistern is emptying and until the completion of a complete flushing action, said device comprising an inverted cup-shaped member and a body member, said body member being configured to freely move within the inner surface of said cup; said cup-shaped member and said body member defining therebetween a changeable volume of substantially surrounded space and having or defining restricted openings for the passage of water into and out of said space, one of said members being provided with means for attachment to said water outlet valve, whereby, upon attachment of said member to said valve, any vertical movement of the water outlet valve will also be affected by said member, and the remaining member being provided with means for attachment to a stationary component of said cistern, and being located so that said body member may reciprocate inside said cup-shaped member, whereby, upon the actuation of said first actuating means, the emptying of the cistern to a predetermined level below said second buoyant means and the consequent completion of the exertion of said maintaining force on said water outlet valve by said second buoyant means, the impact shock of the reseating of said valve disk on said valve seat at the completion of a partial flush is reduced by the resistance of the water forced through said restricted openings as a result of the final descent of said valve attached member towards said cistern attached member.

The body member of the shock-damping device of the present invention can be of any suitable configuration, and thus it could be in the form of a cylindrical body, a spherical body with a depending stem, a helical screw, or other geometric and non-geometric shapes. Preferably, said member will be a simple plate with a depending stem, and said plate may be of any suitable configuration, such as circular, hexagonal, square, etc., provided that the cross-section of the cup is of similar configuration, to provide for close proximity between the edge of the plate and the inner surface of the cup. As stated herein, the remaining member is provided with means for attachment to a stationary component of the cistern, which component can be a side wall of the cistern, the cistern floor, or preferably the water outlet fitting thereof.

There can be found in the prior art several patents which bear a superficial resemblance to the shock-damping device of the present invention.

For example, in 1887 there issued U.S. Pat. No. 364,289, directed to a water closet tank flushing apparatus in which a lifting pump was attached to the tank valve and the period of descent of said valve was determined by the time taken for the water drawn into the pump to escape from its barrel. Similarly, in 1899 there issued U.S. Pat. No. 622,418, in which the upward movement of a waste pipe and valve of a water cistern causes the rack of a rack-and-segment gear connection to draw a piston forward in a piston chamber, thereby filling said chamber with water, which ensures a slow closing of the valve as a result of the interaction of said piston and piston chamber and said rack-and-segment gear connection.

Similarly, U.S. Pat. No. 4,587,679 teaches the use of a piston slidable in a cylinder as the sole means for controlling the discharge of water from a toilet cistern. As stated in said patent in column 1, lines 54–57: "Appropriate water discharge quantities can be simply controlled by the degree in which the operating lever is pressed, which may be determined by the user's judgment."

As will be realized, both the structure and purpose of the flushing devices taught in each of said patents is entirely different from that defined herein, since each was designed to control the entire descent of the flush valve and was not designed to work in combination with a buoyant valve engaging means which begins to function only upon the completion of the exertion of a maintaining force on said water outlet valve by said buoyant means, and only for the brief period of the reseating of the valve disc on the valve seat at the completion of a predetermined flushing action, controlled by said buoyant means.

Furthermore, mere combination of any of said devices with the toilet bowl flush system of U.S. Pat. No. 4,305,163 is not obvious, or even possible, without major modification of one or both systems, since each of the devices of U.S. Pat. Nos. 364,289; 622,418 and 4,587,679 renders the partial flush mechanism of said latter patent inoperative, and the full flush mechanism of said patent redundant.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 4 is an isometric exploded view of a second embodiment of the invention;

FIG. 5 is an isometric exploded view of the embodiment of FIG. 4, showing attachment of the stem and disc member;

FIG. 6 is a sectional view of a further embodiment of the invention;

Figure 1:
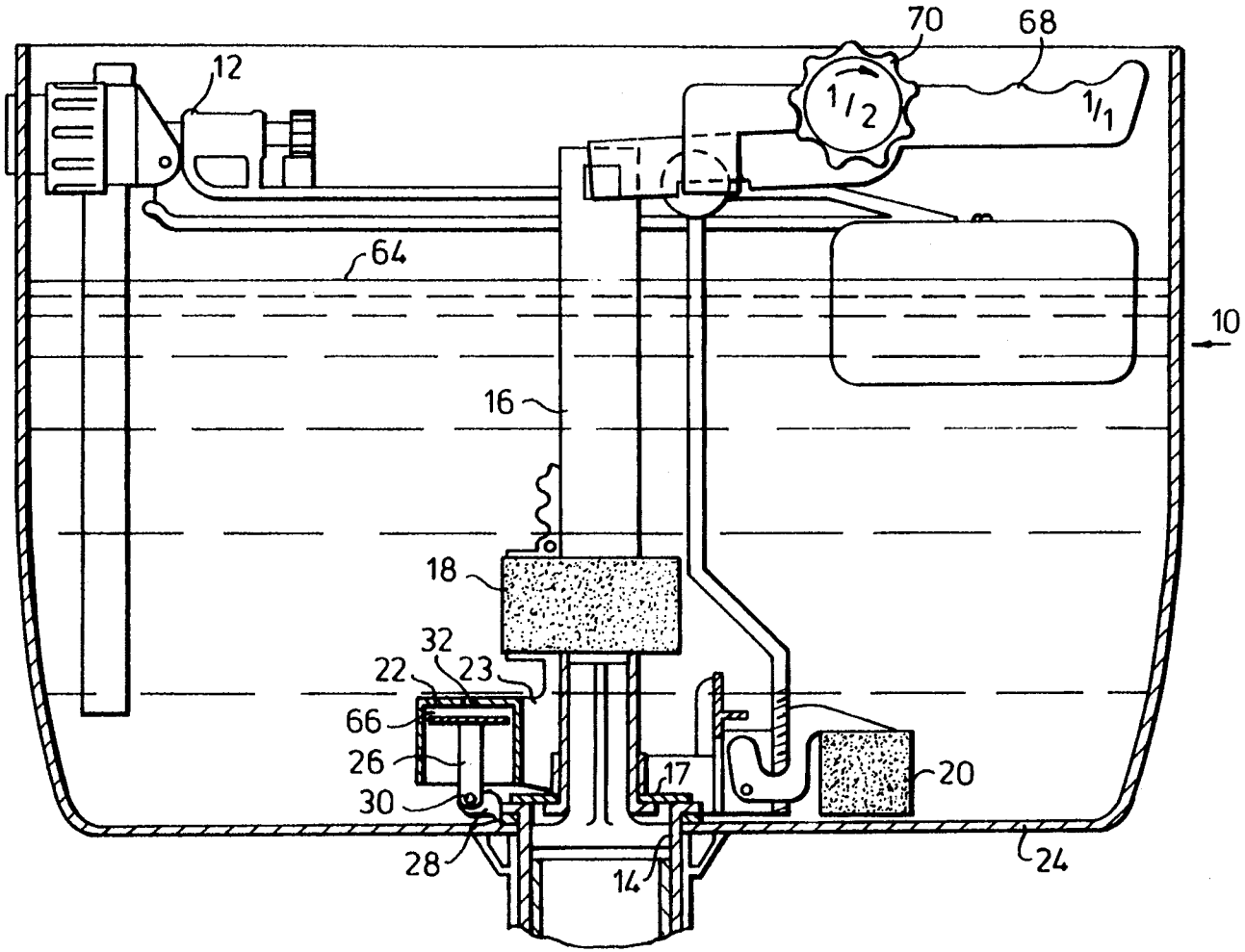
FIG. 1 is a sectional view of one embodiment of the shock-absorbing device, as assembled to a water outlet valve in a flush cistern, shown with the cistern full.
Figure 2:
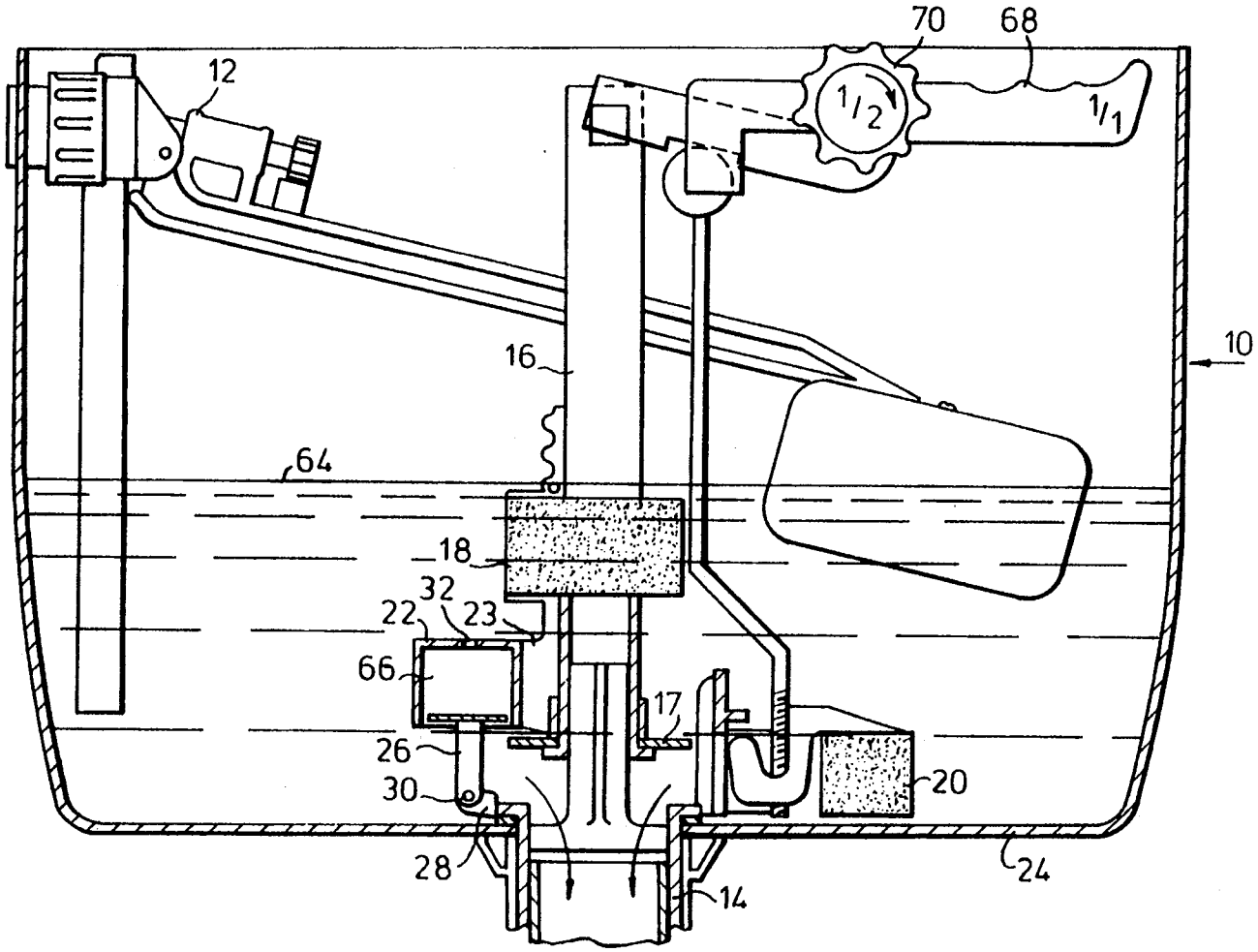
FIG. 2 shows the components of FIG. 1, near the completion of a partial flush.
Figure 3:
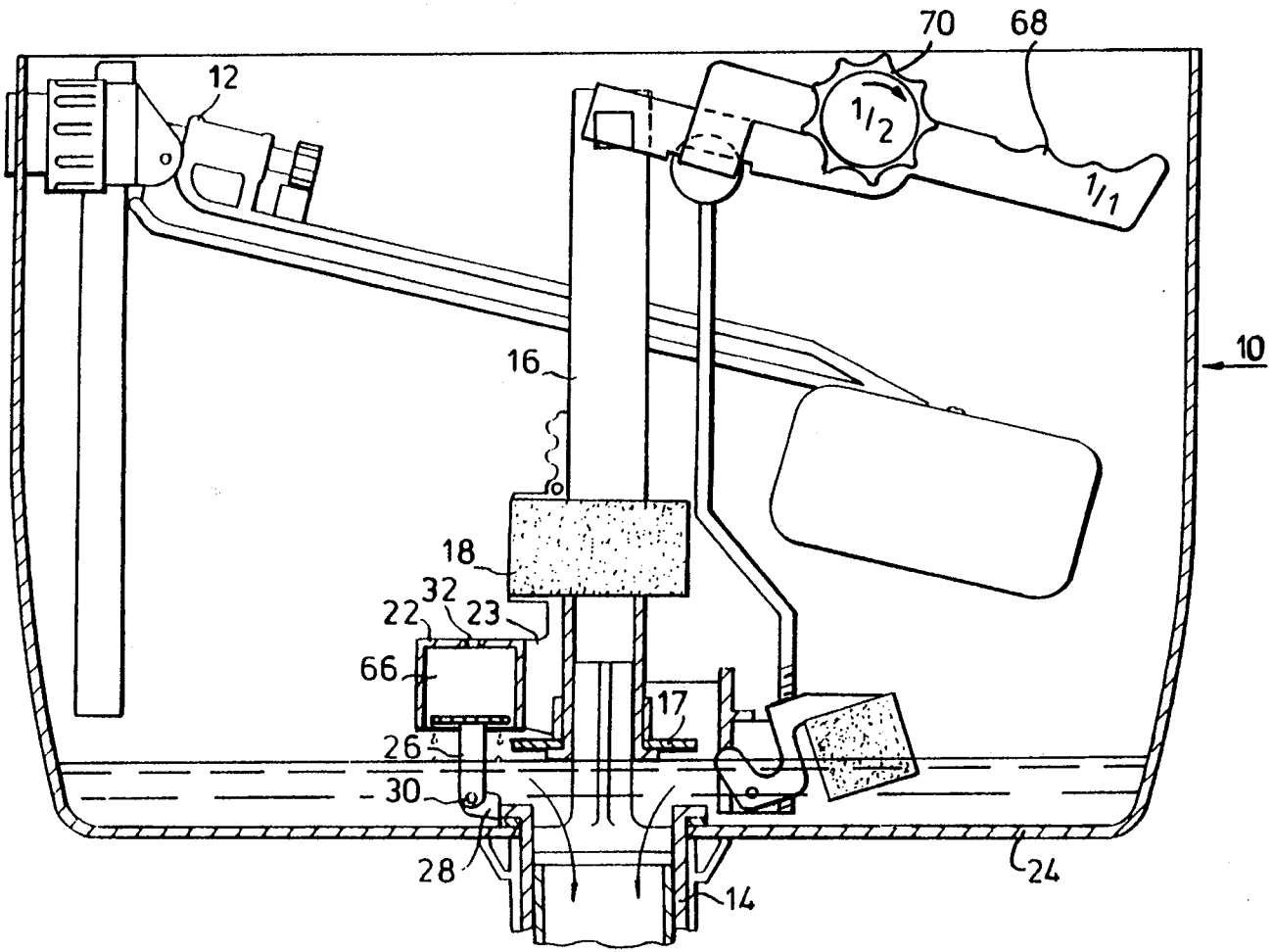
FIG. 3 shows the components of FIG. 1, near the completion of a full flush.

With reference to FIGS. 1, 2 and 3, there is shown a flush cistern tank 10, fitted with a water inlet control mechanism 12. A water outlet fitting 14 is sealed and opened by means of a water outlet valve 16, having a seal disc 17 at its lowest extremity. A float 18, attached to valve 16, provides for partial flushes, while float 20 operates a restraining force on valve 16 for complete flushes, the mode of construction and operation being fully explained in U.S. Pat. No. 4,305,163.

An inverted cup member 22 is rigidly attached to water outlet valve 16 by means of arm 23, and is positioned to be in proximity to the floor 24 of tank 10. Coaxial with the inverted cup member 22 is a plate and stem member 26. The lower end of the stem is attached to lugs 28 extending from water outlet fitting 14, by means of a pin 30, and is restrained thereby from vertical movement. Pin 30 allows for partial angular displacement of the stem member 26 along a vertical plane towards and away from said liftable outlet valve 16, this being of utility for overcoming any misalignment between the plate and the stem member 26 and the inverted cup member 22, and also for easy assembly of the unit.

In a further embodiment of the invention (not shown), the plate and stem member is attached to valve 16, and cup member 22 is attached to water outlet fitting 14.

FIG. 4 shows a further embodiment in exploded form, with the cup member being partially cut away to expose its form. A cup-shaped member 22 is held in inverted orientation by attachment arm 23. An orifice 32 is provided in the closed end of cup 22, to allow for the escape of air which enters volume 66 after a full flush, as shown in FIG. 3. Said orifice is made relatively small, e.g., 1/16 of an inch outer diameter, since its function is to allow the escape of air and to minimize the outward flow of water. The braking effect in this embodiment is controlled by water passing through the restricted area defined between the inner wall of the cup member and the outer surface of the plate member, as described in more detail further below.

In the embodiment of FIG. 4, the plate stem member 26 will also be interchangeably referred to as a "circular disc", which is, in fact, the preferred configuration of the plate. Circular disc 26, as shown in this embodiment, is provided with a plurality of apertures 34.

A flexible washer 36 is retained on the upper face of disc 26 by means of a mushroom head 38, and apertures 34 are covered by flexible washers 36. The lower end of the plate stem member 26 is fitted with a boss 40, having a bore 42 oriented perpendicular to the axis of the stem.

FIG. 5 shows a preferred method of attachment of the disc 26 to water outlet fitting 14. A pair of lugs 28 extend from fitting 14, each lug being provided with a bore 44. The space between lugs 28 allows for the free insertion of boss 40. Pin 30 is inserted through bores 44 and 42, resulting in attachment of the plate stem member 26 to a stationary component of the cistern, member 26 retaining freedom for angular displacement over a short arc.

FIG. 6 illustrates a further preferred embodiment of the invention. The disc of plate stem member 26 is provided with a number of apertures 34. The stem of member 26 is hollow, thus allowing for the free axial movement of rod 46, joined to cover plate 48. Fluid pressure on the outer face of plate 48 causes said plate to contact the disc of plate stem member 26; fluid pressure in the opposite direction causes plate 48 to lift and thereby allow fluid to flow through apertures 34.

Figure 7:
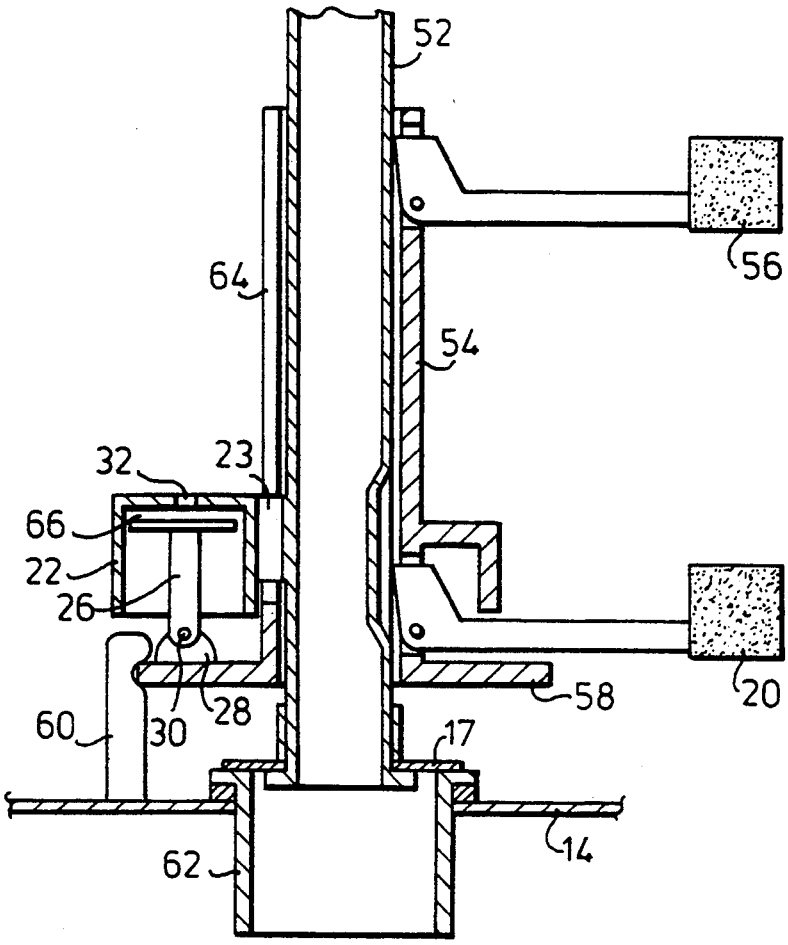
FIG. 7 is a sectional view of an embodiment adapted to a different type of flush mechanism.

FIG. 7 is a sectional view of an embodiment adapted to a different type of water outlet valve 521. The cup-shaped member 22 is attached in inverted orientation to valve 52 by means of arm 23. A sleeve 54 holds means 20, 56 for restraining the vertical motion of valve 52. Sleeve 54 has a flange 58 carrying lugs 28, which lugs carry plate stem member 26, as previously explained. A plurality of clips 60, preferably three in number, serves to hold flange 58 stationary. Clips 60 allow water to flow from the cistern to outlet pipe 62. Sleeve 54 is provided with a vertical slot, which is long enough to allow free vertical movement for arm 23, and therefore of the cup-shaped member 22.

Figure 8:
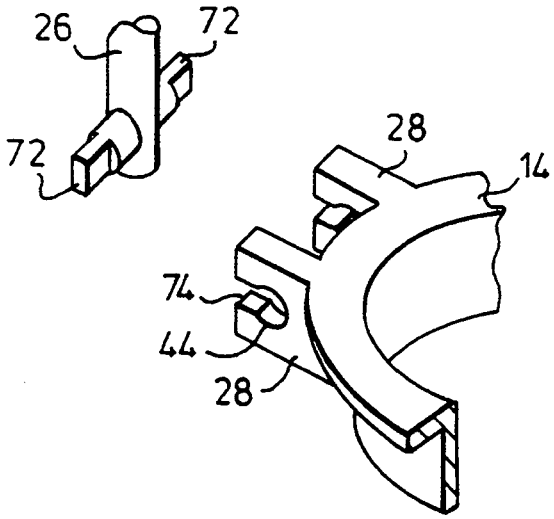
FIG. 8 is an isometric exploded view, showing a preferred configuration of the stem and disc member and its attachment lug.

FIG. 8 is an exploded view showing a further preferred configuration for the attachment of the stem and disc member 26 to the lugs 28, which are provided with a circular bore 44, and a slot 74 whose width is less than the diameter of bore 44 and joins bore 44 to an outer edge of lug 28. The stem and disc member 26 is provided with projections 72 in the form of cylinders having flattened faces on planes parallel to the long axis of the stem and disc member 26. The distances between the flattened faces of the projection 72 is slightly less than the width of the slot 74, thereby making assembly of the stem 26 between lugs 28 possible. The diameter of projections 72 is slightly less than the diameter of bore 44, thereby enabling the stem and disc member 26 to assume its upright operational orientation. In this preferred configuration, there are no loose parts; assembly is fast and requires no tools, and there is no danger of the stem and disc member 26 becoming inadvertently disengaged from lugs 28.

Operation of the device can best be explained with reference to FIG. 2, which shows the components of the flush mechanism as they appear near the completion of a partial flush cycle. Valve 16 is in its raised open position, resulting in water outflow through water outlet fitting 14. Water level 64 drops rapidly to a predetermined level below buoyant means 18 and consequently buoyant means 18 loses the support provided by the water and releases valve 16 for vertical fall. However, water is trapped in volume 66 between the cup-shaped member 22 and the plate and stem member 26, this water providing support to cup-shaped member 22 and thereby preventing its fast descent, and, as member 22 is joined to valve 16 by arm 23, also prevents the fast descent of valve 16. The weights of valve 16, buoyant means 18, arm 23 and cup 22 combine to pressurize water trapped in volume 66, which results in this water exiting from volume 66 around the sides of member 26 and through open end 27 of cup 22 and thereby the impact shock of the reseating of valve disk 17 on the valve seat of fitting 14 is reduced.

While the benefits of slowing the descent velocity of valve 16 have been explained, it will be realized that on activation of the cistern's flush mechanisms, it is necessary to raise valve 16, which is affected by the user moving levers 68 or 70. There is, however, little need to reduce the upward velocity of valve 16, and it is desirable to allow for possible fast operation of levers 68 and 70. To achieve this end, it is preferable to allow the volume 66 to be increased quickly without requiring the flush mechanism to exert excessive force. FIGS. 4 and 6 show how this is achieved by allowing substantially free passage of water into volume 66 through apertures 34. As valve 16 is raised to initiate a flush, vertical movement of cup member 22 causes an increase in volume 66, which results in reduced fluid pressure therein. Thereafter, water enters volume 66 through apertures 34, deflecting flexible washer 36 on entry. The effect of the foregoing is that valve 16 can be raised quickly while meeting with little resistance. However, descent of valve 16 causes a reduction in volume 66 and an increase of fluid pressure therein, this causing washer 36 to seal apertures 34. The trapped water must therefore leave volume 66 through the narrow passages remaining, around the sides of disk 36 of member 36. The resistance of the water to flow through these passages causes the cup member 22 to exert a resisting force through arm 23 to valve 16, and thereby the descent velocity of valve 16 is reduced. The resultant imppact as valve 16 reaches its lower closed position is much reduced, thereby reducing shock, vibration, noise and excessive wear.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A flush valve mechanism for controlling the flushing action of water through the water outlet of a flush cistern, comprising, in combination:

a) a water outlet valve liftable off said water outlet to effect said flushing action, said water outlet valve having a valve disk for sealing a valve seat of the water outlet and an upwardly extending valve stem, and further having an effectively negative overall buoyancy when the cistern is at least partially full;

b) buoyant means associated with said water valve for exerting a maintaining force on said water outlet valve at the completion of the lifting thereof and to hold it open while the cistern is emptying and until the completion of a predetermined flushing action; and c) a shock damping device, comprising an inverted cup-shaped member and a body member, said body member being configured to freely move with the inner surface of said cup, said cup-shaped member and said body member defining therebetween a changeable volume of substantially surrounded space and having restricted openings for the passage of water into and out of said space, one of said members being provided with means for attachment to said water outlet valve, and the remaining member being provided with means for attachment to a stationary component of said cistern, and being located so that said body member may reciprocate inside said cup-shaped member, whereby, upon the emptying of the cistern to a predetermined level of water below said buoyant means and the consequent completion of the exertion of said maintaining force on said water outlet valve by said buoyant means, impact shock of the reseating of said valve disk on said valve seat is reduced by the resistance of the water forced through said restricted openings as a result of the final descent of said valve attached member towards said cistern attached member, wherein said body member is a plate-and-stem member, wherein the plate of said plate-and-stem member is provided with at least one aperture, and wherein a flexible washer is attached to a face of said plate opposite the stem, in a manner whereby said flexible washer will allow passage of a fluid flowing from the direction of the stem, but will seal the aperture before a fluid pressurized to flow in the reverse direction.

2. A flush valve mechanism for controlling the flushing action of water through the water outlet of a flush cistern, comprising, in combination:

a) a water outlet valve liftable off said water outlet to effect said flushing action, said water outlet valve having a valve disk for sealing a valve seat of the water outlet and an upwardly extending valve stem, and further having an effectively negative overall buoyancy when the cistern is at least partially full;

b) buoyant means associated with said water valve for exerting a maintaining force on said water outlet valve at the completion of the lifting thereof and to hold it open while the cistern is emptying and until the completion of a predetermined flushing action; and c) a shock damping device, comprising an inverted cup-shaped member and a body member, said body member being configured to freely move with the inner surface of said cup, said cup-shaped member and said body member defining therebetween a changeable volume of substantially surrounded space and having restricted openings for the passage of water into and out of said space, one of said members being provided with means for attachment to said water outlet valve, and the remaining member being provided with means for attachment to a stationary component of said cistern, and being located so that said body member may reciprocate inside said cup-shaped member, whereby, upon the emptying of the cistern to a predetermined level of water below said buoyant means and the consequent completion of the exertion of said maintaining force on said water outlet valve by said buoyant means, impact shock of the reseating of said valve disk on said valve seat is reduced by the resistance of the water forced through said restricted openings as a result of the final descent of said valve attached member towards said cistern attached member, wherein said body member is a plate-and-stem member, wherein the plate of said plate-and-stem member is provided with at least one aperture, and further being provided with a cover plate axially mounted to afford reciprocal movement on top of said plate-and-stem member, said cover plate sealing said aperture when in contact with said plate and allowing substantially free passage for fluid when in space relationship to said plate.

* * * * *